United States Patent [19]

Schwartz

[11] 3,996,459

[45] Dec. 7, 1976

[54] TROUBLE LIGHT GUARD AND REFLECTOR

[75] Inventor: Frederic W. Schwartz, Providence, R.I.

[73] Assignee: Cable Electric Products, Inc., Providence, R.I.

[22] Filed: Mar. 25, 1975

[21] Appl. No.: 561,858

[52] U.S. Cl. ..... 240/54 A; 240/102 B

[51] Int. Cl.[2] ..... F21V 15/02; F21V 21/00

[58] Field of Search ..... 240/54 R, 54 A, 102, 240/8.18

[56] References Cited

UNITED STATES PATENTS

| | | | |
|---|---|---|---|
| 2,717,308 | 9/1955 | Kevorkian | 240/102 B |
| 2,730,612 | 1/1956 | Westendorf | 240/54 R |
| 3,119,568 | 1/1964 | Broder | 240/102 B |
| 3,814,927 | 6/1974 | Buzza | 240/54 A |
| 3,819,930 | 6/1974 | Lamont | 240/54 A X |

*Primary Examiner*—George H. Miller, Jr.
*Attorney, Agent, or Firm*—Max Schwartz

[57] ABSTRACT

A trouble light guard and reflector molded of plastic dielectric material for rapid mounting on a trouble light. The structure is molded in two halves hingedly joined at the top. One half comprises longitudinal and transverse spaced bars permitting the light to pass through. The other half comprises a reflector and is segmented into three angularly positioned panels. The open side is similarly angled. At the juncture, the plastic is pliable and acts as the hinge. At the outer ends, both halves are provided with integral arcuate sections adapted to surround a light socket. One arcuate section has an opening at each end and the other arcuate section has resilient hook members adapted to enter and lock in the openings to lock the guard to the light socket. A plastic hook is provided with a depending shank having a button end. The hinge portion is provided with a central opening having a slot for resiliency. The button end of the hook can be forced into the opening to lock in place. The entire structure is dielectric, light and strong.

4 Claims, 5 Drawing Figures

TROUBLE LIGHT GUARD AND REFLECTOR

BACKGROUND OF THE INVENTION

The conventional trouble light comprises a length of electrical cord with a light socket and bulb at the free end. To protect the light, a wire guard with a course mesh is mounted around the bulb. In some cases, a metal reflector is positioned in the wire guard and a hook is added for suspending the light. The guards and reflectors must be carefully mounted and insulated to prevent shorting. The guard is usually mounted and clamped on the light socket with screws and clamps.

SUMMARY OF THE INVENTION

The present invention provides a light, strong, plastic combination guard and reflector that can be molded in virtually a single unitary piece. The device is molded in two halves integrally joined at the top by a flexible hinge portion. One half is open meshed bars to allow the light to pass through, and the other half forms the reflector. The free edges of the two halves are provided with complementary arcuate portions which nest around the light socket. Means are provided for locking the arcuate portions together to mount the device on the light socket.

Figure 1:
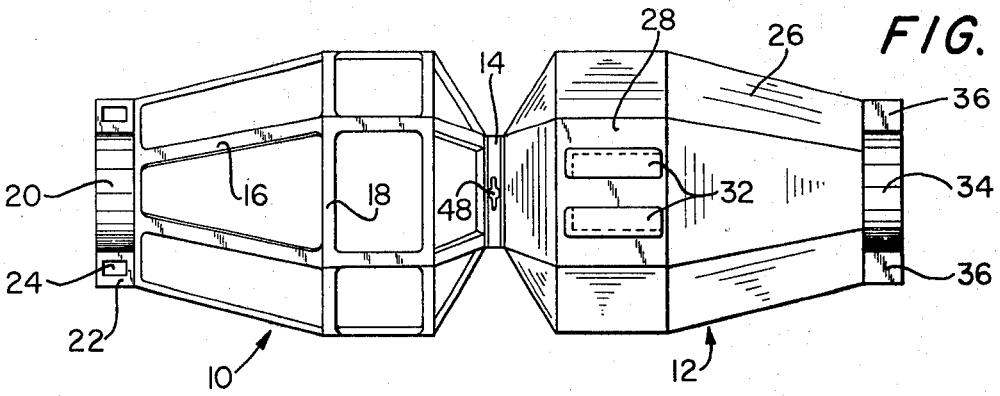
FIG. 1 is a top plan view of the combination guard and reflector in open position showing the outside.
Figure 2:
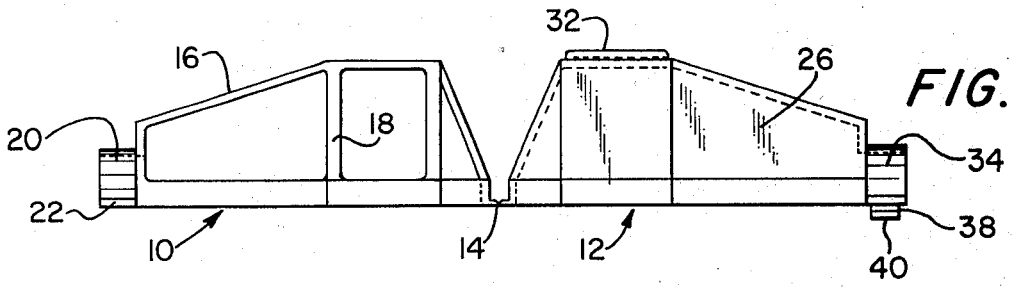
FIG. 2 is a side elevation of the device as shown in FIG. 1.
Figure 3:
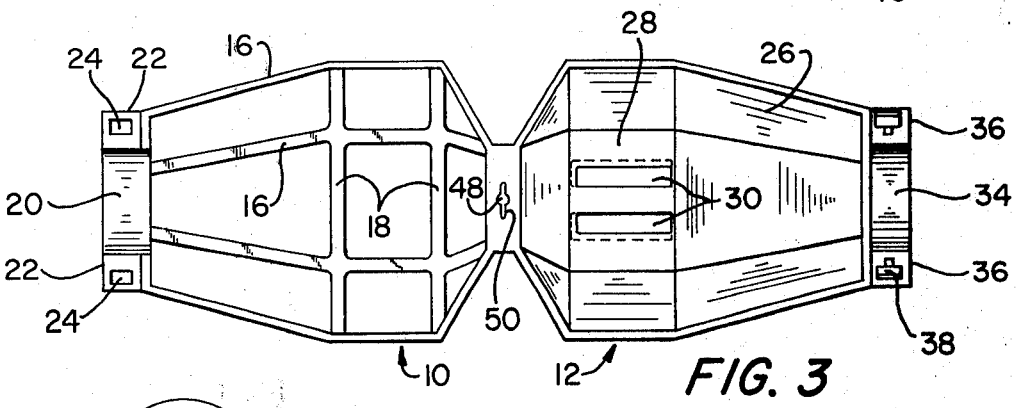
FIG. 3 is a bottom plan view of the device, showing the inside.
Figure 4:
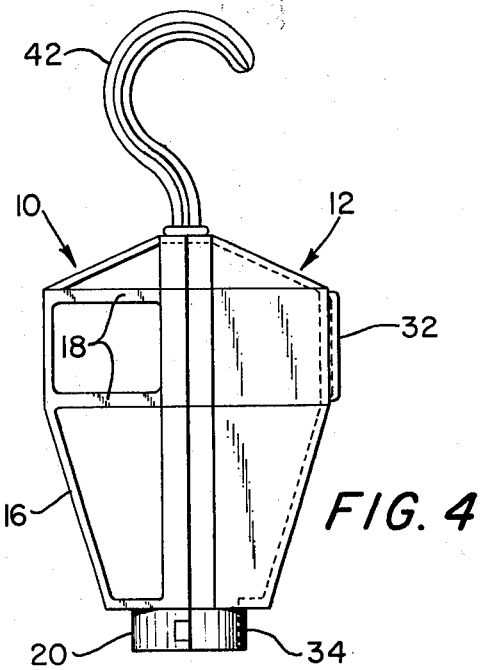
FIG. 4 is a side elevation of the device in assembled position around the light socket.
Figure 5:
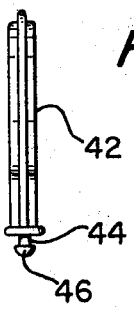
FIG. 5 is an edge view of the hook member.

DESCRIPTION OF THE INVENTION.

Referring more in detail to the drawings, the device is molded of a dielectric plastic material in a single integral construction. As it leaves the mold, the device presents two half sections 10 and 12 integrally connected at the top ends by a pliable web of plastic material 14.

The section 10 comprises an open grillwork consisting of elongated bars 16 and transverse bars 18. The bars 16 and 18 are angularly disposed to provide three angularly connected portions forming a half circumference. At the outer end, the section 10 is provided with an arcuate semi-circular portion 20 with flattened ends 22. Each end 22 is provided with a rectangular opening 24.

The complementary section 12, connected at the top to the section 10 by the integral web 14, comprises a solid reflector surface. The section 12 is formed into three angularly connected panel portions 26 forming a semi-circle complementary to the angles and formation of the section 10. The central panel portion 28 is provided with a pair of spaced parallel ventilating openings 30. The openings 30 are covered by rectangular pieces 32 mounted on the outside, the vent being at the side edges of the pieces 32.

The section 12 is also provided at the outer end with an arcuate semi-circular portion 34 with flattened ends 36. Each end 36 is provided with an integral rectangular stud 38 having a beveled end 40. When the device is being mounted on the bulb socket of a trouble light, the two halves 10 and 12 are bent around the socket so that the arcuate portions 20 and 34 surround the socket. Pressure on these portions now forces the studs 38 into the openings 24 with a snap action, the edges of the studs overlapping the edges of the openings to lock the parts together.

A plastic hook 42 is provided with an integral shank 44 depending from the bottom end and terminating in an enlarged button end 46. The integral connecting web 14 is provided with a central opening 48 having slots 50 for resiliency. When the botton end 46 of the hook 42 is pushed into the opening 48, the slots 50 allow sufficient 'give' to permit the end to snap into the opening and lock the hook to the guard. Note that the hook 42 will swivel to allow ready suspension where required.

I have thus provided a simple readily moldable trouble light guard and reflector unit which is moldable in virtually a single integral piece, is entirely dielectric, and readily mountable on the trouble light socket without tools. The entire assembly is easy and rapid.

Other advantages of the present invention will be readily apparent to a person skilled in the art.

I claim:

1. A trouble light guard and reflector comprising a molded plastic dielectric member having two half portions connected by an integral web of flexible plastic material at their top edges, one half portion comprising a plurality of spaced longitudinal and transverse bars forming a wide open mesh portion adapted to permit the passage of light, the other half portion constituting a reflector for the light, and means for locking the bottom ends of said half portions to each other around the light socket, said half portions each forming three angularly disposed panels arranged in a semicircle.

2. A device as in claim 1, wherein said locking means comprises rectangular openings adjacent the bottom edge of one half member and complementary hooked studs extending adjacent the bottom edge of the other half member.

3. A device as in claim 1, wherein said half portion forming the reflector is provided with vent openings.

4. A device as in claim 1, wherein said hinge portion is provided with a central opening, and a dielectric hook is provided with an enlarged button bottom end adapted to snap into said opening to provide a suspension hook for the device.

* * * * *